US005525036A

United States Patent [19]

Park

[11] Patent Number: 5,525,036

[45] Date of Patent: Jun. 11, 1996

[54] SUCTION STRUCTURE OF A SIROCCO FAN HOUSING

[75] Inventor: In C. Park, Kyungki-do, Rep. of Korea

[73] Assignee: Goldstar Co., Ltd., Seoul, Rep. of Korea

[21] Appl. No.: 980,153

[22] Filed: Nov. 23, 1992

[30] Foreign Application Priority Data

Nov. 29, 1991 [KR] Rep. of Korea ..... 21812/1991
Apr. 13, 1992 [KR] Rep. of Korea ..... 6128/1992

[51] Int. Cl.[6] ..... F01D 1/02

[52] U.S. Cl. ..... 415/208.1; 415/58.2; 415/58.3

[58] Field of Search ..... 415/208.1, 203, 415/58.2, 58.3; 416/187, 189, 192

[56] References Cited

U.S. PATENT DOCUMENTS 3,011,693 12/1961 Downs et al. ..... 415/58.3
4,202,296 5/1980 Nonnenmann et al. ..... 415/208.1
4,255,080 3/1981 Wilson ..... 415/58.2
4,357,914 11/1982 Hauser ..... 415/58.3

FOREIGN PATENT DOCUMENTS 4023724 4/1991 Germany ..... 415/208.1

*Primary Examiner* Edward K. Look
*Assistant Examiner* Mark Sgantzos
*Attorney, Agent, or Firm* Birch, Stewart, Kolasch & Birch

[57] ABSTRACT

This invention relates to a suction structure of a sirocco fan housing, the suction structure including a separate fluid suction guide, or a bellmouth member having a fluid suction guide integral therewith, disposed in a suction opening of the housing to reduce noises generated by a vortex flow in the fan and minimize a dead zone and a vortex phenomenon generated at the forward end portion of the fan, thereby enhancing efficiency of the fan.

1 Claim, 6 Drawing Sheets

SUCTION STRUCTURE OF A SIROCCO FAN HOUSING

BACKGROUND OF THE INVENTION

1. Field of the Invention

This invention relates to a housing of a sirocco fan widely used in an air conditioner or every field requiring a blowing operation of hot air or cold air, and more particularly to a suction structure of a sirocco fan housing, which is capable of improving blowing efficiency of a sirocco fan and reducing suction noises of the fan.

2. Description of the Prior Art

Generally, a prior art sirocco fan housing comprises a pair of right and left side plates 1, 1 and scroll plate 2, as shown in FIG. 1 of the accompanying drawings. One of the side plates 1 is formed with a suction opening 1*a* for intaking air into a sirocco fan 3, and the other is provided with a motor 5 for driving the fan 3, a motor securing plate 6 and a plurality of vibration proofing members 7. Such a sirocco fan housing is of a snail shell-like shape including a throttle portion 2*a* provided by a bent portion of the scroll plate, a scroll portion 2*b* and a discharge opening 2*c* provided by an open top thereof.

With this construction, if the fan driving motor 5 is driven to rotate the sirocco fan 3 secured to a motor shaft 5*a*, as shown in FIG. 2, centrifugal force is exerted upon air existing in the interior 3*b* of the fan by vanes 3*a* of the sirocco fan, so that negative pressure is created in the interior of the fan to intake ambient air into the interior through the suction opening 1*a* formed in the sirocco fan housing. Then, the sucked air is expelled toward the discharge opening 2*c*, as shown by the arrows, with an increased flow velocity by virtue of the vanes 3*a* of the sirocco fan rotated by the driving force of the motor 5. At this time, the expelled air is in part accumulated in the scroll portion 2*b* due to the throttle portion 2*a* so that dynamic pressure produced by the air flow velocity is converted into static pressure, then guided to the discharge opening 2*c* and discharged therethrough to the exterior.

In this prior sirocco fan 3, however, since according to a characteristic of the fan, a fluid intake is in the direction of the rotary shaft of the fan, undergoes a 90° change of direction to flow radially, and then is discharged through the discharge opening 2*c*, a dead zone 4, as drawn by oblique lines in FIG. 2, is formed at a suction opening side forward end portion 3*c* of the fan 3 due to inertia of particles entrained in the air, so that a suction passage may not be established thereat. The extent of the dead zone corresponds to 20 % ~30% of the length of each vane. Moreover, since the pressure of the exterior of the sirocco fan 3 is higher than that of the interior, great vortex flows as shown by the arrows in FIG. 2 are produced near the dead zone 4, i.e., at the forward end portion 3*c* of the fan, resulting in a static pressure loss, a lowering of efficiency of the fan and generation of flowing noises. Especially, since the suction passage may not be established at the forward end portion 3*c*, the circumferential area of the portion must be compensated to the extent of the dead zone such that each vane becomes longer than it needs, thereby leading to a wider sirocco fan.

SUMMARY OF THE INVENTION

With the foregoing drawbacks of the prior art in view, it is an object of the present invention to provide a suction structure of a sirocco fan housing, comprising a fluid suction guide disposed in a suction opening of the housing not only to improve blowing efficiency, thereby enabling to obtain a thin and miniature fan, but also to achieve reduction in flowing noises.

To achieve the above object, there is provided according to one form of the present invention a suction structure of a sirocco fan housing, comprising a fluid suction guide of a trumpet shape such as a flared cylinder disposed in a suction opening of the housing and including a fluid guide tube having an outside diameter less than the diameter of the suction opening and provided at one end with an outwardly curved portion.

According to another form of the present invention, there is provided a suction structure of a sirocco fan housing, comprising a fluid suction guide of a trumpet shape such as a flared cylinder including a fluid guide tube having a suction opening and an outwardly curved portion integrally formed at the rear end thereof; and a bell-mouth member having a suction opening for guiding a fluid and a ring flange secured to a side plate of the housing, and coupled to the guide tube concentrically mounted therein by a plurality of brackets.

DESCRIPTION OF THE PREFERRED EMBODIMENT

The invention will now be described in detail, by way of example, with reference to FIGS. 3 to 8 of the accompanying drawings.

Figure 3:
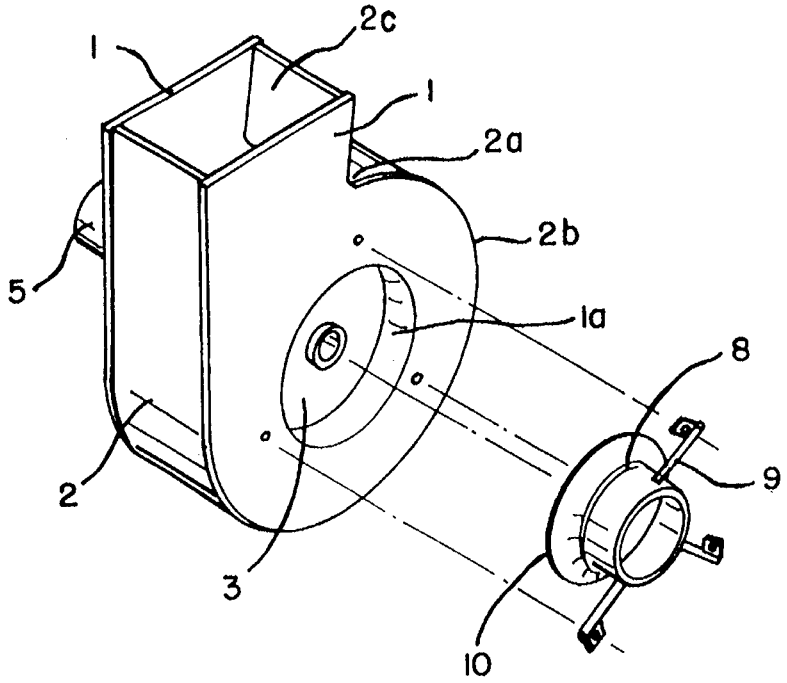
FIG. 3 is an exploded perspective view showing one embodiment of the present invention.
Figure 4:
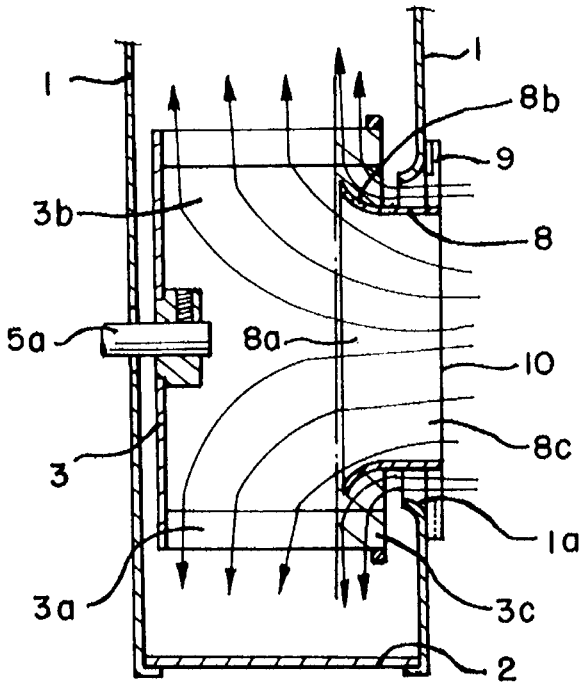
FIG. 4 is a cross-sectional view showing a fluid flow pattern in the embodiment shown in FIG. 3.

Reference is first made to FIGS. 3 and 4 which illustrate a suction structure of a sirocco fan housing according to one embodiment of the present invention. The sirocco fan housing itself is identical in construction with that mentioned in the description of the prior art and comprises a pair of right and left side plates 1, 1, one of them being formed with a suction opening 1*a* and the other being provided with a motor 5 and a sirocco fan 3 secured to a rotary shaft 5*a* of the motor for rotation therewith; and a scroll plate 2 providing a throttle portion 2*a*, a scroll portion 2*b* and a discharge opening 2*c*. The suction structure of one embodiment of the present invention comprises a separate fluid suction guide 10 disposed in the suction opening 1*a* of the fan housing.

The fluid suction guide 10 is of a trumpet shape such as a flared cylinder which comprises a cylindrical fluid guide tube 8 having an outside diameter less than the diameter of the suction opening 1*a* of the housing and formed at its rear end 8*a* with a portion 8*b* curved outwardly toward a forward end portion 3*c* of the sirocco fan; and a plurality of brackets 9 for securing the guide tube to the side plate 1 of the housing.

Further, the rear end 8*a* of the fluid guide tube 8 comprising the curved portion 8*b* has diameter slightly less than the inside diameter of the suction opening 1*a* so as not to interfere with vanes 3*a* of the sirocco fan 3, so that the guide tube 8 may be inserted into the housing through the suction opening, and then fixedly secured to the housing by means of the brackets 9.

Figure 1:
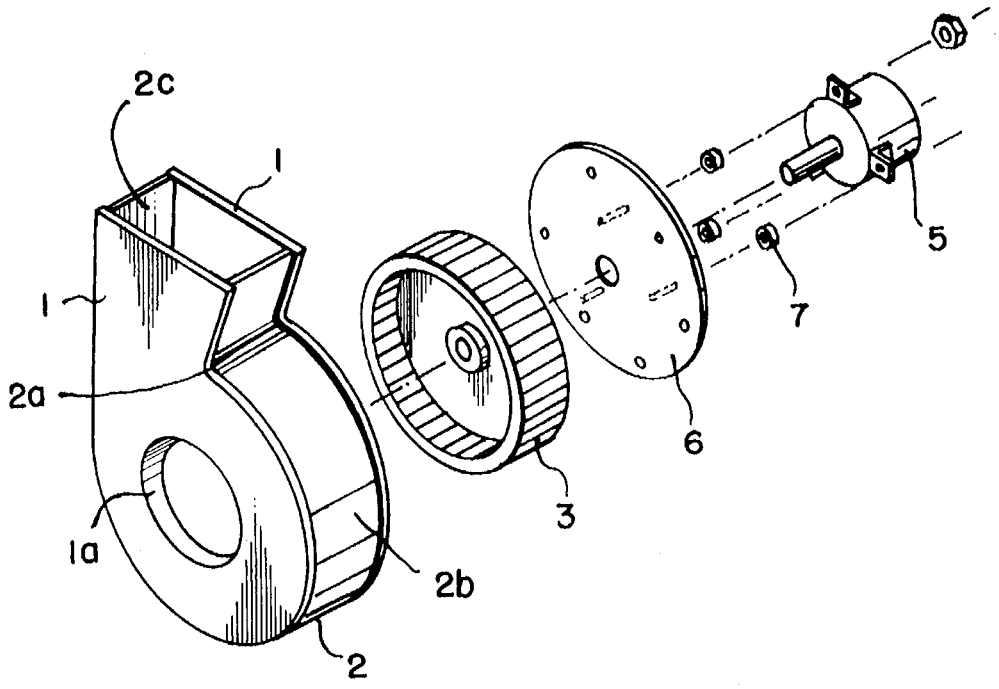
FIG. 1 PRIOR ART
FIG. 1 is an exploded perspective view showing the construction of a a prior art sirocco fan.
Figure 2:
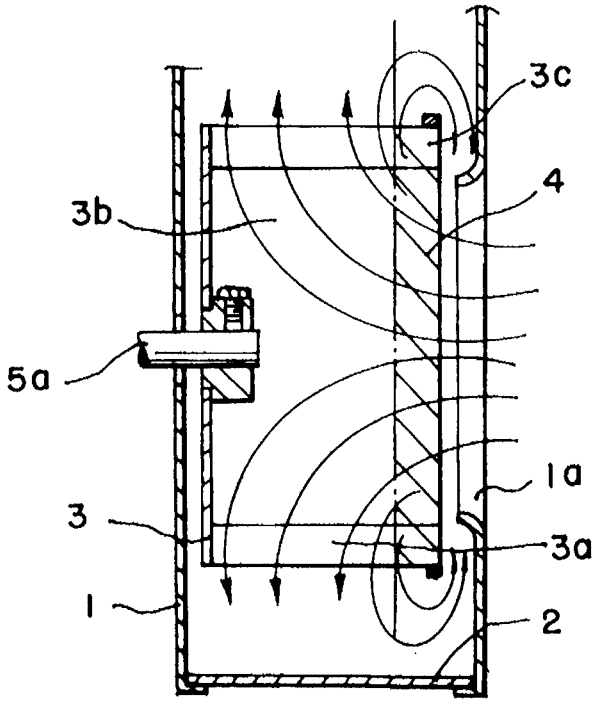
FIG. 2 PRIOR ART
FIG. 2 is a cross-sectional view of the fan of FIG. 1 in an assembled state, showing a fluid flow pattern in its operation.

More specifically, as shown in FIG. 4, the fluid guide tube 8, with the outwardly curved portion 8*b* thereof positioned in the interior of the sirocco fan 3, is fixedly secured to the side plate 1 of the housing by means of the brackets 9 attached to a forward end 8*c* of the guide tube. As a result, the rear end 8*a* of the fluid guide tube is located at a so-called dead zone inevitably established in the prior art construction shown in FIG. 2, so that it may effectively prevent a vortex phenomenon generated at the forward end portion 3*c* of the sirocco fan 3.

With this construction, when air is taken into the housing through the suction opening 1*a* with rotation of the sirocco fan 3, ambient air existing around the wall of the suction opening is guided along the outer peripheral surface of the fluid guide tube 8 of the fluid suction guide 10, to thereby be introduced into the forward end portion 3*c* of the fan, while air in the suction opening is taken into the interior 3*b* of the fan, and then directed to the remaining portions of the vanes 3*a* other than the forward end portion 3*c*. Then, the air directed to the vanes 3*a* is passed through the vanes and expelled toward the discharge opening 2*c* with flow velocity increased by the centrifugal force induced by the rotating vanes.

The expelled air is in part accumulated in the scroll portion 2*b* due to the throuttle portion 2*a* such that dynamic pressure produced by the air flow velocity is changed into static pressure, and then eventually discharged through the discharge opening 2*c* to the exterior.

From the foregoing it will be appreciated that the present invention provides advantages in that according to the structural characteristics as described above, the fluid suction guide disposed at the inlet side forward end portion of the sirocco fan can effectively not only suppress generation of the dead zone and vortex phenomenon at the forward end portion of the fan, which have been regarded as structural problems with the conventional sirocco fan, but also prevent a lowering of efficiency due to a vortex loss, thereby increasing the efficiency of the fan up to about 30%. Therefore, an extra width of the fan to be provided so as to compensate for the dead zone may be reduced, thereby allowing miniaturization of the product. Further, the vortex loss may be minimized, so that the suction noise level of the fan itself may be reduced by about 2 dB.

FIGS. 5 to 8 show another embodiment of the present invention. In the previous embodiment, as the fluid suction guide is secured to the side plate of the housing through the brackets coupled to the guide, difficulties arise in accurately aligning the center of the guide with the center of the suction opening. If the suction guide is not mounted in accurate registry with the suction opening, but eccentrically mounted out of registry with the opening, a smooth flow of the air being sucked may not be obtained, so that the guide fails to satisfactorily act as a guide and fully prevent the vortex phenomenon, resulting in a lowering of efficiency of the fan and generation of flowing noises. Further, since the forward end of the suction guide protrudes beyond the suction opening, an air flow in not smooth, thereby leading to a lowering of flowing efficiency.

Figure 5:
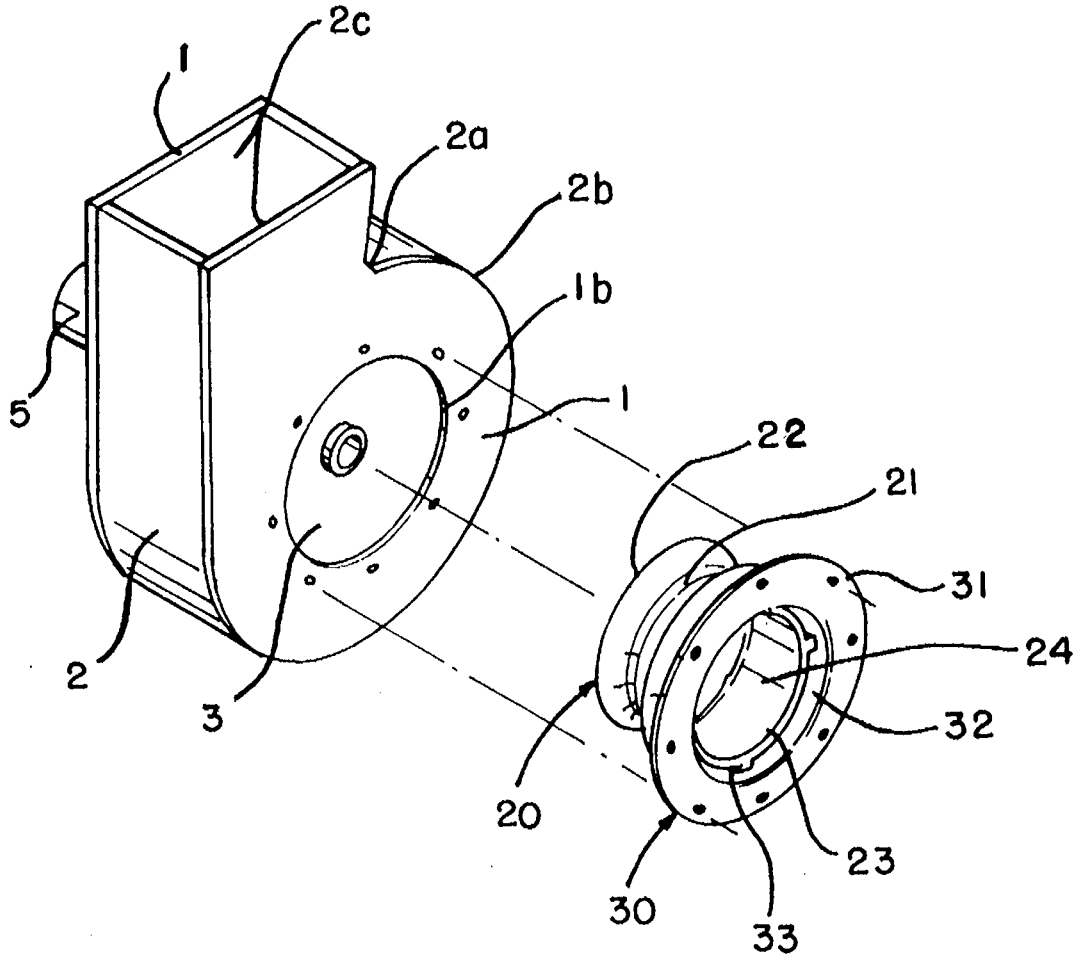
FIG. 5 is an exploded perspective view showing another embodiment of the present invention.

To solve such problems, according to the embodiment shown in FIG. 5, the suction structure of the sirocco fan housing comprises a fluid suction guide 20 of a trumpet shape such as a flared cylinder similar to that in the previous embodiment, and a bellmouth member 30 secured to the side wall 1 of the housing and acting to hold the suction guide. The bellmouth member 30 has a ring flange 31 to be secured to the side wall 1 of the housing and a suction opening 32 defined by a curved portion to guide a fluid being sucked.

The fluid suction guide 20 comprises a fluid guide tube 24 having a curved portion 21 formed at a rear end 22 thereof and is concentrically mounted and held within the bellmouth member 30 by a plurality of brackets 33 which interconnect a forward end 23 of the guide tube and the bellmounth member. The forward end 23 of the guide is disposed at a position spaced backwardly from the front face of the ring flange 31 of the bellmouth member 30.

Figure 6:
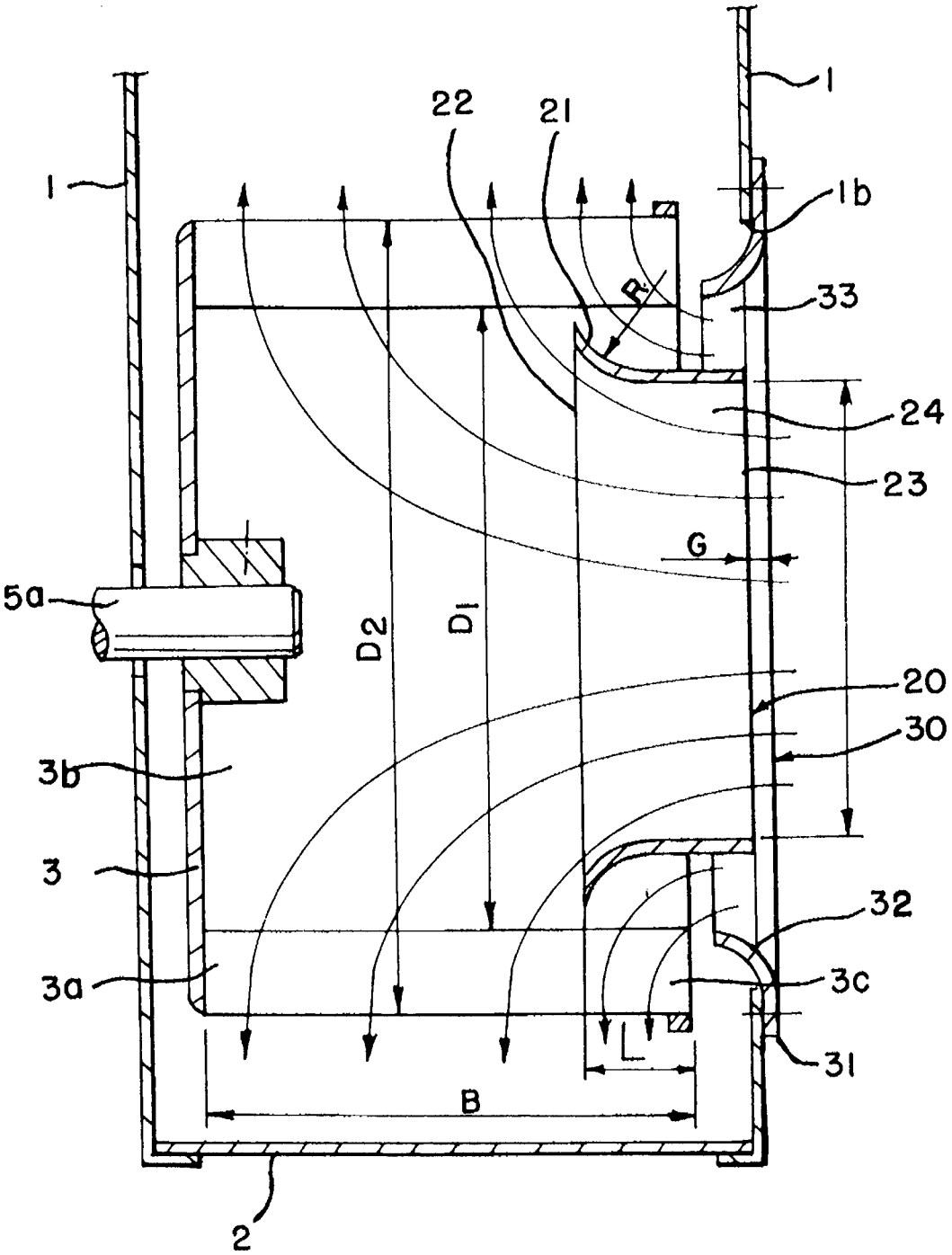
FIG. 6 is a cross-sectional view showing a fluid flow pattern in the embodiment shown in FIG. 5.

Operation and effect of the suction structure thus constructed will now be explained. As shown in FIG. 6, when air is taken into the housing through the suction opening 32 with rotation of the sirocco fan 3, ambient air existing around the suction opening 32 with rotation of the sirocco fan 3 is guided along the outer peripheral surface of the fluid guide tube 24 of the suction guide 20, to thereby be introduced into the forward end portion 3*c* of the fan, while air in the suction guide opening 20 is taken into the interior 3*b* of the fan, and then directed to the remaining portions of the vanes 3*a* other than the forward end portion 3*c*.

Then, the air directed to the vanes 3*a* is passed through the vanes and expelled toward the discharge opening 2*c* with flow velocity increased by the centrifugal force induced by the rotating vanes and the driving force of the motor 5. The expelled air is in part accumulated in the scroll portion 2*b* due to the throttle portion 2*a* such that dynamic pressure produced by the air flow velocity is converted into static pressure, and then eventually discharged through the discharge opening 2*c*.

According to this operational feature, the dead zone and the vortex phenomenon tending to occur at the forward end portion of the prior sirocco fan housing may be effectively suppressed, to thereby prevent a lowering of efficiency due to the vortex loss. As a result, the efficiency of the fan may be increased greatly.

To obtain optimum conditions minimizing the vortex loss and suppressing suction noises, experiments have been made on the sirocco fan having the following specification:

Inside diameter ($D_1$) of the fan=$\phi$153;

Outside diameter ($D_0$) of the fan=$\phi$180;

Length (B) of each vane=58;

Revolutions=1,070 rpm.

The experiments have been carried out under different conditions as set forth in Table 1 below;

TABLE 1

| | A | B | C |
|---|---|---|---|
| $D_0/D_1$ | 0.866 | 0.894 | 0.922 |
| L/B | 0.15 | 0.20 | 0.25 |
| G | 0 mm | 5 mm | 10 mm |

$D_0$=diameter of the suction opening of the fluid suction guide;

$D_1$=inside diameter of the sirocco fan;

L=distance between the rear end of the guide tube and the forward end of the fan;

B=length of the vane;

G=distance between the front face of the bellmouth member and the forward end of the guide tube.

Figure 7:
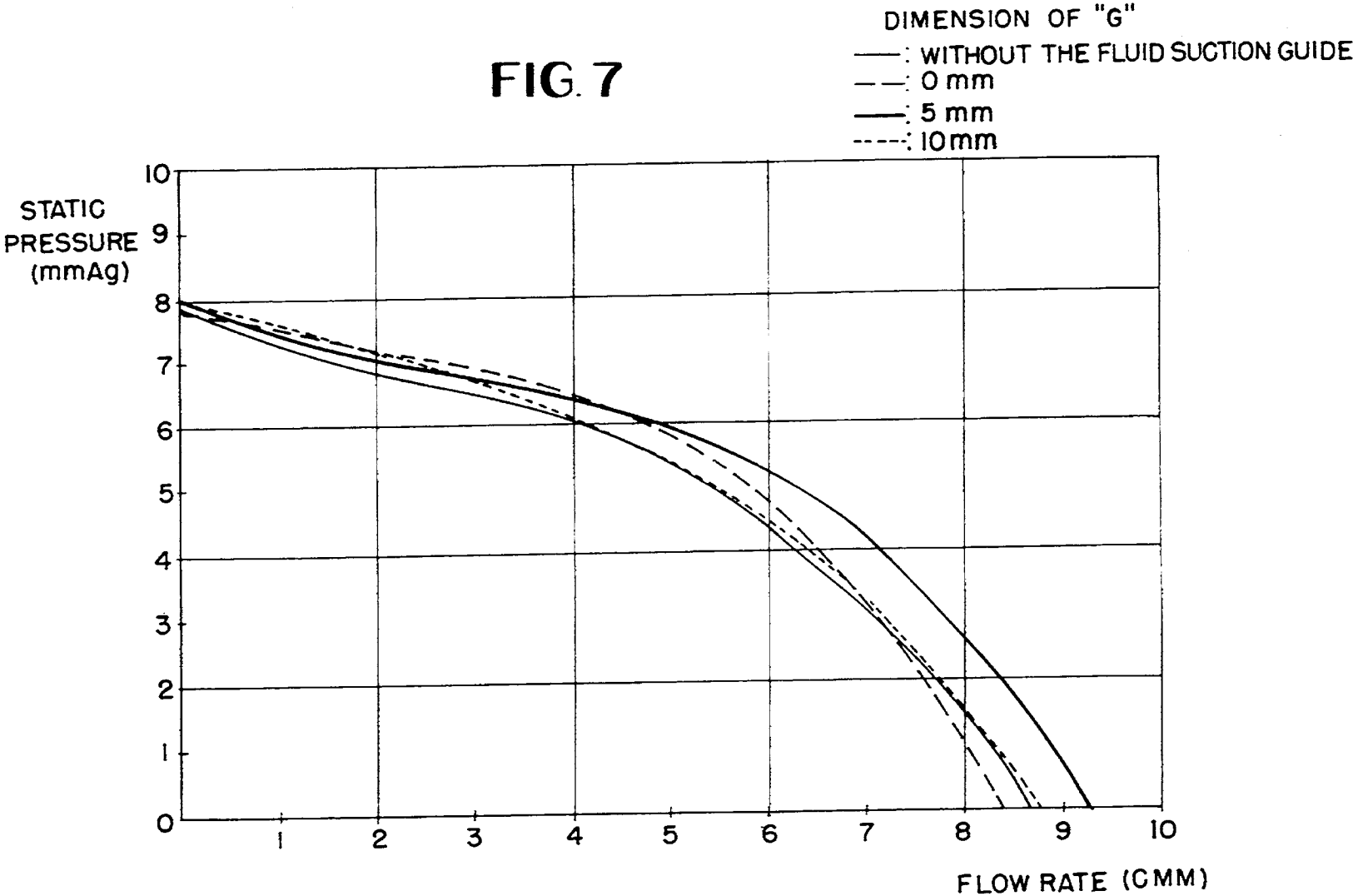
FIG. 7 is a graph showing relationships of pressure versus a flow rate depending upon different positions of a fluid suction guide of the embodiment shown in FIG. 5.
Figure 8:
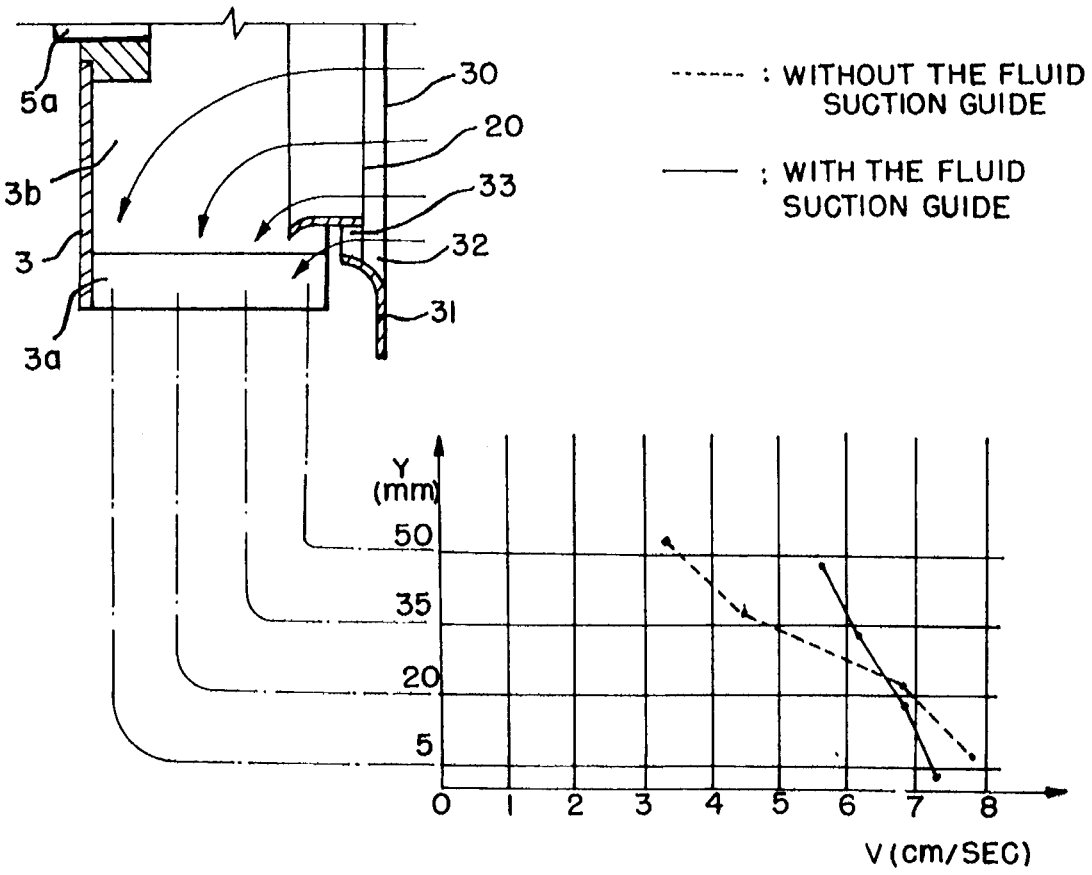
FIG. 8 is a graph showing a flow velocity profile of a discharged fluid in the sirocco fan of FIG. 5 as compared with that in the prior art.

The results obtained from the experiments are plotted in FIG. 7.

The graphs reveal that when the forward end of the fluid suction guide is positioned at a distance of 5 mm from the front face of the bellmouth member and the fan has the values of $D_0/D_1$=0.894 and L/B=0.20, as indicated at Column B of the above table, the most excellent performance is obtained. That is, from the results of the experiments, it will be appreciated that when the sirocco fan housing is constructed such that the fluid suction guide is integrally connected to the bellmouth member, the ratio of the diameter ($D_0$) of the suction opening of the suction guide to the inside diameter ($D_1$) of the fan, $D_0/D_1$, is in the range of 0.88 to 0.91, the ratio of the curvature radius (R) of the curved portion of the guide tube to the inside diameter ($D_1$) of the fan, $R/D_1$, is in the range of 0.04 to 0.055, the ratio of the distance (L) between the rear end of the guide tube and the forward end of the fan to the length (B) of each vane of the fan, L/B, is in the range of 0.18 to 0.22 and the distance (G) between the front face of the bellmouth member and the forward end of the suction guide is in the range of 2 mm to 5 mm, the optimum performance may be provided.

In the sirocco fan housing having the conditions as set forth above, as shown in FIG. 9, the air discharged toward the discharge opening by the vanes of the fan has a substantially uniform velocity, so that turbulence noises of a high frequency wave resulting from an uneven flow velocity may be reduced by about 1~1.5 dB and the flow rate may be increased over the entire range of static pressure by about 10~30% as compared with the case without the fluid suction guide.

These effects contribute to effective suppression of the dead zone and the vortex phenomenon generated at the forward end portion of the suction opening of the sirocco fan, resulting in increased efficiency of the fan and reduction in turbulence noises.

While the invention has been shown and described with reference to preferred embodiments thereof, it will be understood that variations and modifications in form and detail may be made therein without departing from the spirit and scope of the invention as defined in the appended claims.

What is claimed is:

1. A suction structure of a sirocco fan assembly including a scroll-shaped housing portion, a sirocco fan rotatably mounted within the housing portion and having a plurality of spaced blades formed thereon, and a suction opening formed in a first side wall of the housing portion, said suction structure comprising:

a fluid guide tube having an inlet end and an outwardly curved portion formed at its rear end; and a bellmouth member concentrically secured to the inlet end of said fluid guide tube at the first side wall of the housing portion; and a plurality of brackets for fixing said fluid guide tube concentrically with said bellmouth member to an inner periphery of said bellmouth member with a predetermined gap between said inner periphery of said bellmouth member and an outer periphery of said fluid guide tube, wherein a ratio of a diameter $D_0$ of the inlet end of said fluid guide tube to an inside diameter $D_1$ of the sirocco fan, $D_0/D_1$, is in the range of 0.88 to 0.91, the ratio of a curvature radius R of said curved portion of said guide tube to the inside diameter $D_1$ of said sirocco fan, $R/D_1$, is in the range of 0.04 to 0.055, the ratio of a distance L between the rear end of said guide tube and a forward end of said sirocco fan, to a length B of each vane of said sirocco fan, L/B, is in the range of 0.18 to 0.22, and a distance G between the front face of said bellmouth member and the inlet end of said guide tube is in the range of 2 mm to 5 mm.

* * * * *